US007990319B2

(12) United States Patent
Boyle

(10) Patent No.: US 7,990,319 B2
(45) Date of Patent: Aug. 2, 2011

(54) RADIO DEVICE HAVING ANTENNA ARRANGEMENT SUITED FOR OPERATING OVER A PLURALITY OF BANDS

(75) Inventor: Kevin Boyle, Horsham (GB)

(73) Assignee: EPCOS AG, Munich (DE)

( * ) Notice: Subject to any disclaimer, the term of this patent is extended or adjusted under 35 U.S.C. 154(b) by 113 days.

(21) Appl. No.: 11/912,837

(22) PCT Filed: Apr. 26, 2006

(86) PCT No.: PCT/IB2006/051302

§ 371 (c)(1),
(2), (4) Date: Jul. 22, 2008

(87) PCT Pub. No.: WO2006/114771

PCT Pub. Date: Nov. 2, 2006

(65) Prior Publication Data

US 2009/0201209 A1 Aug. 13, 2009

(30) Foreign Application Priority Data

Apr. 27, 2005 (EP) ..... 05300328

(51) Int. Cl.
*H01Q 1/38* (2006.01)
*H01Q 3/24* (2006.01)
*H01Q 21/00* (2006.01)

(52) U.S. Cl. ..... 343/700 MS; 343/876; 343/893

(58) Field of Classification Search ..... 343/700 MS, 343/702, 846, 876, 893
See application file for complete search history.

(56) References Cited

U.S. PATENT DOCUMENTS

| | | | | |
|---|---|---|---|---|
| 6,040,806 | A * | 3/2000 | Kushihi et al. | 343/853 |
| 6,295,030 | B1 | 9/2001 | Kozakai et al. | |
| 6,300,909 | B1 * | 10/2001 | Tsubaki et al. | 343/700 MS |
| 6,476,769 | B1 | 11/2002 | Lehtola | |
| 6,674,411 | B2 | 1/2004 | Boyle | |
| 6,693,594 | B2 * | 2/2004 | Pankinaho et al. | 343/700 MS |
| 7,136,020 | B2 * | 11/2006 | Yamaki | 343/702 |
| 2003/0142022 | A1 | 7/2003 | Ollikainen et al. | |
| 2004/0257285 | A1 | 12/2004 | Quintero et al. | |

FOREIGN PATENT DOCUMENTS

| | | | |
|---|---|---|---|
| EP | 1256998 | A2 | 11/2002 |
| JP | 11-317612 | A | 11/1999 |
| JP | 2001-119238 | A | 4/2001 |
| JP | 2003-124730 | A | 4/2003 |
| WO | 03094290 | A1 | 11/2003 |
| WO | 03096474 | A1 | 11/2003 |
| WO | 2004102744 | A1 | 11/2004 |
| WO | 2005018045 | A1 | 2/2005 |

* cited by examiner

*Primary Examiner* — Shih-Chao Chen
(74) *Attorney, Agent, or Firm* — Slater & Matsil, L.L.P.

(57) ABSTRACT

This radio device operating over a plurality of bands comprises a casing having a front cover and a back cover, an antenna arrangement, a radio frequency circuit set and a matching unit for connecting the antenna arrangement to the radio frequency circuit set. The following measures are proposed: —the antenna arrangement is formed by at least two antenna parts, each of which being related to a set of bands, —the antenna parts are placed close together, —the arrangement comprises a part that is normal to the front cover and another one that is near the back cover and feeding points, —the matching unit comprises control switching means for tuning the arrangement to each band. Thanks to these measures, the coverage of the band is obtained with satisfactory performance.

9 Claims, 4 Drawing Sheets

RADIO DEVICE HAVING ANTENNA ARRANGEMENT SUITED FOR OPERATING OVER A PLURALITY OF BANDS

TECHNICAL FIELD

The present invention relates to a radio device operating over a plurality of bands comprising a casing having a front cover and a back cover, an antenna arrangement, a radio frequency circuit set and a matching unit for connecting the antenna arrangement to the radio frequency circuit set

BACKGROUND

Radio devices, such as mobile phone handsets, incorporate an internal antenna. The antennas are small (relative to the working wavelength). So, the matching for a large band becomes difficult. Moreover, the radio devices must operate over a plurality of bands, which lie between 820 MHz and 2200 MHz. Another requirement is that the radiated energy is the lowest possible for the head of the user (SAR).

SUMMARY

It is an object of the invention to satisfy all these more or less contradictory requirements.

The invention is based on the following patent documents: The application WO 03/094290, which discloses notably means for matching an antenna and U.S. Pat. No. 6,674,411, which discloses a planar inverted F antenna (PIFA antenna).

The invention proposes a radio device of the type defined in the opening paragraph, which provides good performances in view to satisfying the cited requirements.

The invention proposes also an antenna arrangement suited for the above-mentioned radio device.

Such a radio device is characterized in that:

- the antenna arrangement is formed by at least two antenna parts, each of which being related to a set of bands,
- the antenna parts are placed close together,
- the arrangement comprises a part that is normal to the front cover and another one that is near the back cover and feeding points
- the matching unit comprises control switching means for tuning the arrangement to each band.

These and other aspects of the invention are apparent from and will be elucidated, by way of non-limitative example, with reference to the embodiment(s) described hereinafter.

DETAILED DESCRIPTION OF ILLUSTRATIVE EMBODIMENTS

Figure 1:
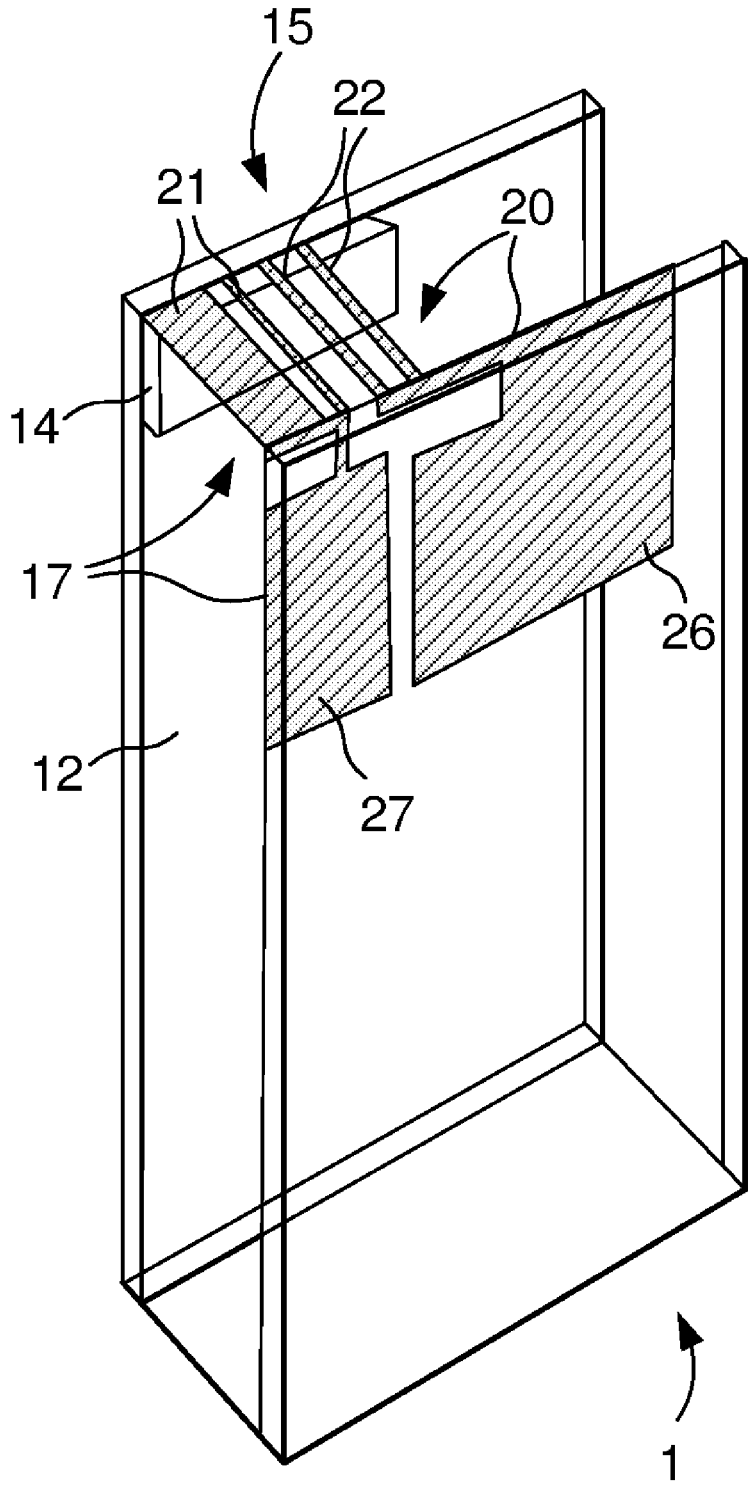
FIG. 1 shows a radio device in accordance with the invention having an antenna arrangement comprising a high-frequency part and a low-frequency part.

In FIG. 1 is represented a radio device 1 in accordance with the invention. This device comprises, inside a casing not shown in the Figure, a PCB plate 12 on which many circuits are placed, among them, a matching circuit unit 14 for matching the RF circuit (not shown) to an antenna arrangement 15.

According to an aspect of the present invention, the antenna arrangement comprises a high-frequency part 17 related to the higher frequency bands and a low frequency part 20 related to the lower frequency bands. Each antenna part comprises normal sub-parts 21 and 22 (respectively for the parts 17 and 20), which are substantially normal to the front cover (i.e. the PCB 12) and back cover sub-parts 27 and 26 (respectively for the parts 17 and 20), which are parallel to the front cover. The bands concerned are in the 820 MHz-2200 MHz range. The antenna arrangement shown is contained within dimensions 40×20×8 mm (approximately the same volume as a conventional dual/tri-band antenna). The PCB measures 100×40×1 mm and is modeled as a copper sheet. The antenna arrangement is designed to retain predominantly series resonant characteristics: this allows the antennas to be tuned using only series components, minimizing losses.

Figure 2:
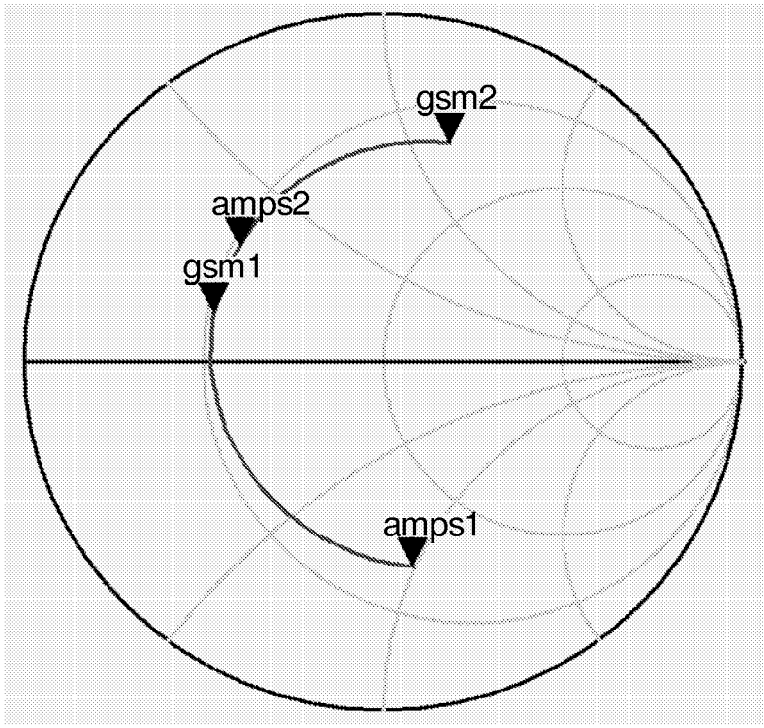
FIG. 2 is a Smith chart showing the reflection coefficient of the low-frequency antenna part.
Figure 3:
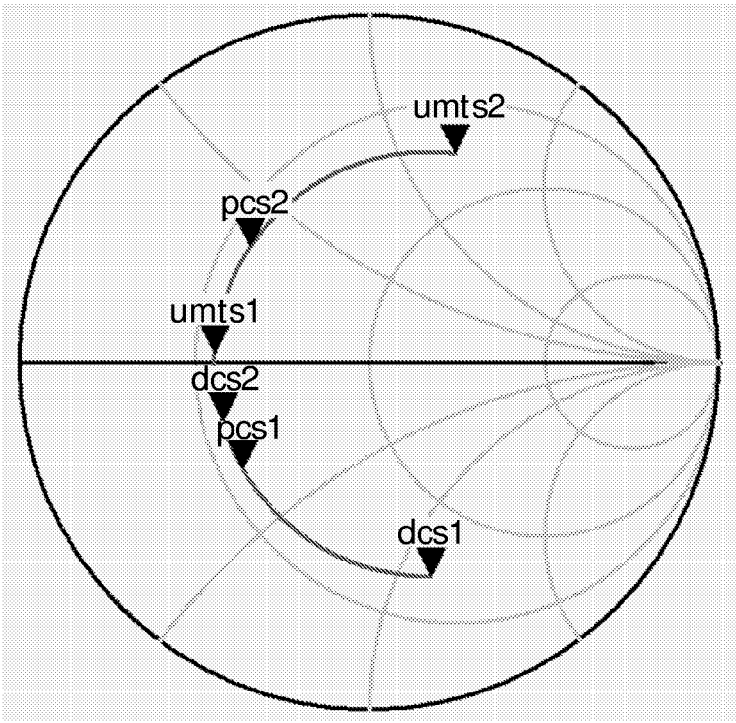
FIG. 3 is a Smith chart showing the reflection coefficient of the high-frequency antenna part.

The reflection coefficients of the low and high-frequency antennas ($S_{11}$ and $S_{22}$ respectively) are shown in FIG. 2 and FIG. 3.

Figure 4:
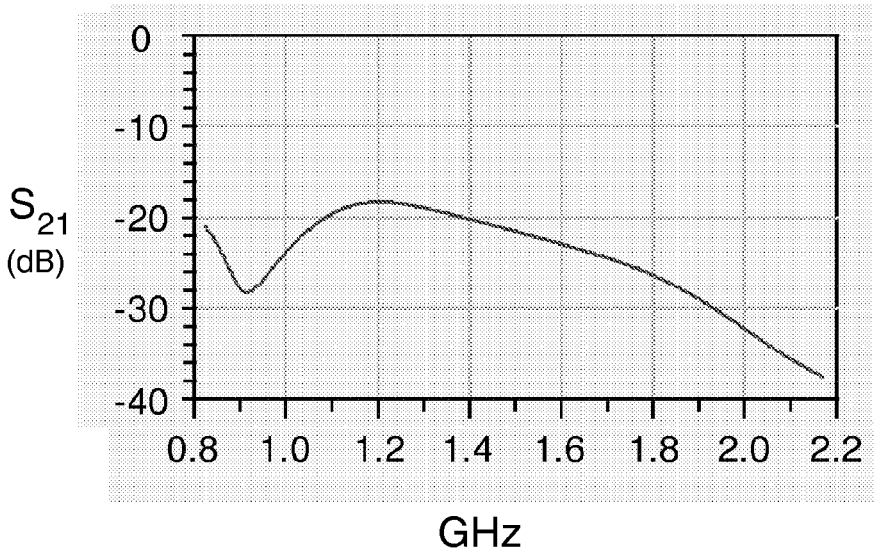
FIG. 4 is a graph representing the insulation between the two antenna parts.

The insulation between the two antennas ($S_{21}$) is shown in FIG. 4. It must be noted that an insulation of better than 20 dB is maintained between the two antenna parts 17 and 20 within the bands of interest, despite their close proximity.

Figure 5:
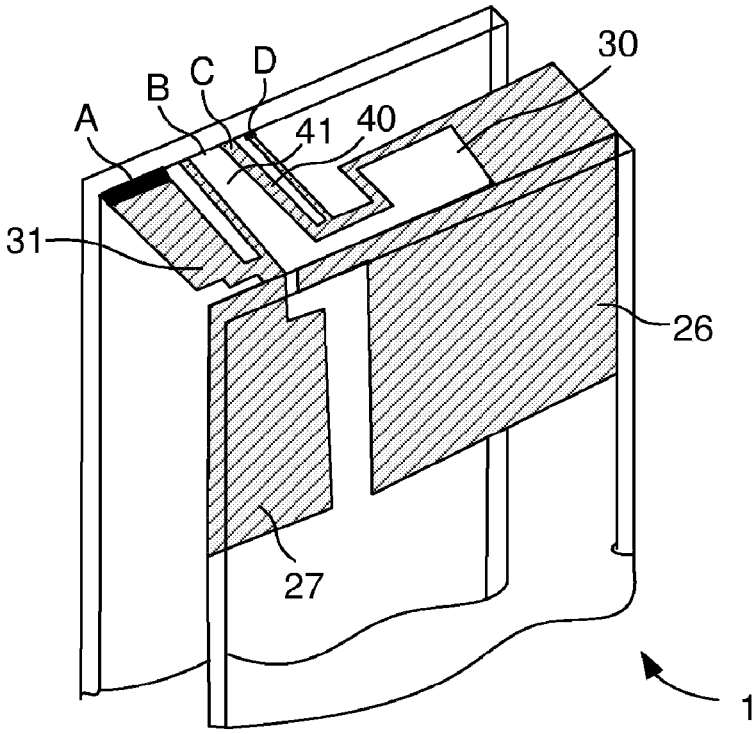
FIG. 5 shows a preferred embodiment of a radio device having an antenna arrangement in accordance with the invention.

In a preferred embodiment, slots 30 and 31 are provided. They are located in the plane of the antenna that is normal to the front and back covers of the phone, as illustrated in FIG. 5. The advantage of placing the slots in this position is that the user is unlikely to place his/her hand over the slot, thus changing its electrical performance. Discrete components or inductors/capacitors disposed on the antenna substrate may also be used in place of the slots in these positions. To reduce the losses in the switches and tuning components, contained in the matching unit 14 as will be disclosed later, the antennas are first tuned approximately to the center frequency of the group of bands that they cover. This can be achieved using either the slots 30 and 31 in the antenna or discrete circuit elements disposed on the antenna. The slots (or discrete components) act as a series inductance in the operation band of the antennas in which they are formed, reducing the antenna size in a manner that conserves bandwidth. The slots may also be configured such that they act as a series connected band-stop filter in the operation band of the other antenna, which increases the insulation between the antennas.

The antenna arrangement of the FIG. 5 comprises several points: A is the supply point for the part antenna 17 and D for the part antenna 20. The points B and C are shorting contacts for shorting pins 40 and 41 of the antenna part 21 and 22 respectively. These shorting connections have the effect of adding shunt inductance across the input terminals of the antenna. This inductance can be tuned out using some shunt capacitance: this gives a band-pass filtering effect and also increases the band-edge resistance of the antennas (by limited "double-tuning"). This can be done while maintaining a predominantly series resonant antenna characteristic. In turn, this minimizes losses in the matching unit, since only series tuning components are required.

Both the slots and the feed and shorting pins in combination with shunt capacitors may act as bandpass filters, increasing the insulation between the two antennas. Both the slots and shorting pins in combination with shunt capacitors may also reduce the worst-case reflection coefficient of the antennas, minimizing the losses in the subsequent matching circuit.

The feed and shorting pin widths are chosen such that the antenna resistance is nominally lower than the system impedance. This minimizes the reflection coefficient over the wide bandwidth that must be covered by each antenna. It also makes an allowance for user interaction, which tends to increase the antenna resistance (while decreasing its quality factor).

Note that the antenna resistance is greater than approximately 20 ohms over each band. Without any further means, the worst-case resistance presented by the antennas to the front-end circuitry would be less than 5 ohms. Since conventional switches have typical "on" resistances of a few ohms, this would result in significant losses: MEMS switches would be required to alleviate this. With the slots, shorting pins and double-tuning capacitors, the worst-case resistance is approximately 25 ohms. Here, conventional switches can be used with acceptable losses.

Figure 6:
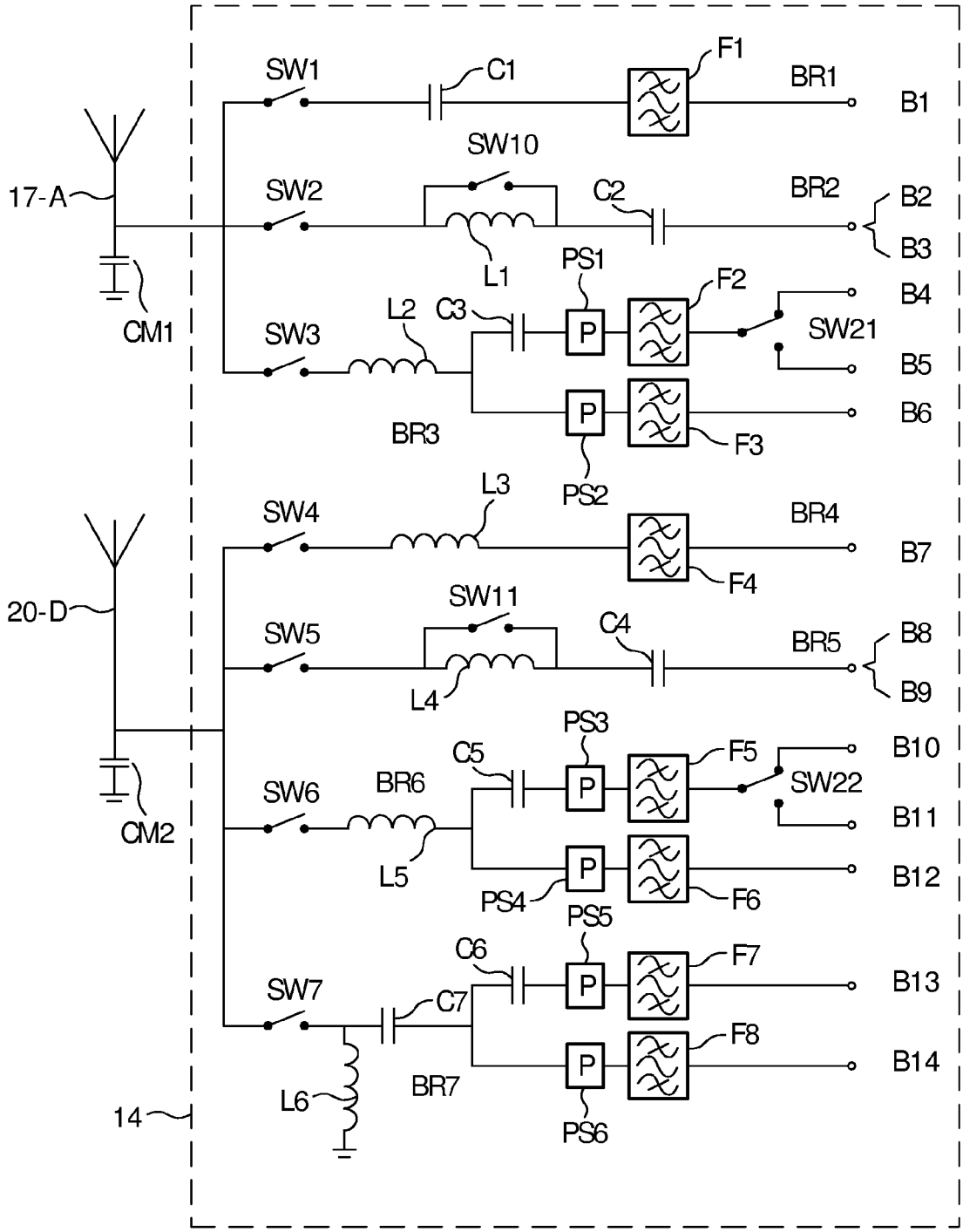
FIG. 6 is a circuit diagram of a matching unit suitable for the device of FIG. 5 in accordance with the invention.

The matching unit shown in FIG. 6 is suitable for operation according to the bands as illustrated in the following table I.

TABLE I

| Band Port | System | TX/RX | Frequency Bands (MHz) |
|---|---|---|---|
| B1 | GSM EU | RX | 925-960 |
| B2 | GSM US | TX | 824-829 |
| B3 | GSM EU | TX | 880-915 |
| B4 | GSM US | RX | 869-894 |
| B5 | WCDMA US | RX | 869-894 |
| B6 | WCDMA US | TX | 824-849 |
| B7 | GSM EU | RX | 1805-1880 |
| B8 | GSM EU | TX | 1710-1785 |
| B9 | GSM US | TX | 1850-1910 |
| B10 | GSM US | RX | 1930-1990 |
| B11 | WCDMA US | RX | 1930-1990 |
| B12 | WCDMA US | TX | 1850-1910 |
| B13 | WCDMA EU | RX | 2110-2170 |
| B14 | WCDMA EU | TX | 1920-1980 |

In FIG. 6 ports are referenced in accordance with Table I. The ports B1-B6 are linked to the antenna part 17-A and the ports B7-B14 to the antenna part 20-D. The filters F1-F8 shown in this Figure are tuned to the middle frequency of the band under consideration. Phase shifters are often associated with these filters in view of improving the matching. The phase shifters PS1-PS6 are associated with the filters F2, F3, F5, F6 F7 and F8, respectively. This matching unit 14 is formed by seven branches BR1-BR7. The port B1 is connected to the branch BR1, the ports B2 and B3 to the branch BR2, the ports B4, B5 and B6 to the branch BR3, the port B7 to the branch BR4, the ports B8 and B9 to the branch BR5, the ports B10, B11 and B12 to the branch BR6 and the ports B13 and B14 to the branch BR7. For matching the antenna arrangement to the various bands, several control means are provided. These control means are constituted by switches. The switches SW1, SW2, . . . SW7 are connected to the outputs of the branches BR1, BR2, . . . BR7. The switches SW10 and SW11 inserted respectively in the branches BR2 and BR5 are controlled in dependence on the band B2 or B3 for the former and B8 or B9 for the latter band port. The switches SW21 and SW22 are switched in accordance with band ports B4 and B5 for the former and B10 and B11 for the latter band ports. Some capacitors C1-C7 improve the matching in combination with inductors L1-L6. Two extra capacitors CM1 and CM2, which are placed near the antenna parts 17-A and 20-D, are provided for perfecting the matching. It must be noted that for each port, only two switches are used for the connection to the antenna arrangement so that the losses and the parasitic effects of these switches are minimized.

The invention claimed is:

1. A radio device operating over a plurality of bands, the radio device comprising:

a casing having a front cover and a back cover, an antenna arrangement, a radio frequency circuit set, and a matching unit for connecting the antenna arrangement to the radio frequency circuit, wherein the antenna arrangement is formed by at least two antenna parts, each one being related to a set of bands, wherein the antenna parts are placed close together, wherein the antenna arrangement comprises a part that is normal to the front cover and another part that is near the back cover and a feeding point, wherein slots are provided in the part that is normal to the front cover to tune antenna resonant frequencies and to provide isolation between the parts, and wherein the matching unit comprises a control switch for tuning the arrangement to each band.

2. The radio device as claimed in claim 1 further comprising discrete circuit elements in the part that is normal to the front cover to tune the antenna resonant frequencies and to provide isolation between the parts.

3. The radio device as claimed in claim 2, wherein the discrete circuit elements comprise an inductor.

4. The radio device as claimed in claim 2, wherein the discrete circuit elements comprise a capacitor.

5. The radio device as claimed in claim 1, wherein the slots act as a series inductance in an operation band of the antennas.

6. An antenna arrangement comprising a plurality of antenna parts, each antenna part having a first part that is normal to a second part, the first part comprising a feed point and a shorting pin and the second part comprising a radiating element, wherein the first part of each antenna part comprises slots to tune antenna resonant frequencies and to provide isolation between the parts.

7. The antenna arrangement as claimed in claim 6 wherein the first part of each antenna part comprises discrete circuit elements to tune the antenna resonant frequencies and to provide isolation between the parts.

8. The antenna arrangement as claimed in claim 7, wherein the discrete circuit elements comprise an inductor.

9. The antenna arrangement as claimed in claim 7, wherein the discrete circuit elements comprise a capacitor.

* * * * *